US012410970B2

(12) United States Patent
Allard et al.

(10) Patent No.: US 12,410,970 B2
(45) Date of Patent: Sep. 9, 2025

(54) ENCAPSULATION SYSTEM FOR A THERMAL BRIDGE BREAKER-TO-METAL LINER

(71) Applicant: WHIRLPOOL CORPORATION, Benton Harbor, MI (US)

(72) Inventors: Paul B. Allard, Coloma, MI (US); Lakshya J. Deka, Mishawaka, IN (US); Gustavo Frattini, St. Joseph, MI (US); Lynne F. Hunter, Dorr, MI (US); Hua Liu, St. Joseph, MI (US); Abhay Naik, Stevensville, MI (US); Eric J. Vasko, St. Joseph, MI (US); Jerry M. Visin, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 18/772,927

(22) Filed: Jul. 15, 2024

(65) Prior Publication Data

US 2024/0369290 A1 Nov. 7, 2024

Related U.S. Application Data

(60) Continuation of application No. 17/835,018, filed on Jun. 8, 2022, now Pat. No. 12,055,344, which is a (Continued)

(51) Int. Cl.
*F25D 23/08* (2006.01)

(52) U.S. Cl.
CPC ..... *F25D 23/082* (2013.01); *F25D 23/085* (2013.01); *F25D 2201/14* (2013.01)

(58) Field of Classification Search
CPC ... F25D 23/082; F25D 23/085; F25D 2201/14
See application file for complete search history.

(56) References Cited

U.S. PATENT DOCUMENTS 2,644,605 A 7/1953 Palmer
2,809,764 A 10/1957 Diamond
(Continued)

FOREIGN PATENT DOCUMENTS

DE 9204365 U1 7/1992
EP 0862032 A2 9/1998
(Continued)

*Primary Examiner* — Matthew W Ing
(74) *Attorney, Agent, or Firm* — Price Heneveld LLP

(57) ABSTRACT

An appliance includes an outer wrapper, an inner liner, a trim breaker having a wrapper channel that receives a wrapper edge of the outer wrapper and a liner channel that receives a liner edge of the inner liner, and an insulation material disposed within an insulating cavity defined therebetween. A multi-component thermal encapsulation material defines pre-mix, application and sealing states. The pre-mix state is defined by the distinct components of the thermal encapsulation material being separated from one another, the application state defined by the distinct components combined together into an uncured state of the thermal encapsulation material, and the sealing state defined by the thermal encapsulation material disposed within the wrapper and liner channels and surrounding the wrapper and liner edges, respectively, in the sealing state that defines a hermetic seal between the trim breaker and the outer wrapper and the inner liner.

20 Claims, 10 Drawing Sheets

Related U.S. Application Data division of application No. 16/309,734, filed as application No. PCT/US2016/055161 on Oct. 3, 2016, now Pat. No. 11,402,149.

(56) References Cited

U.S. PATENT DOCUMENTS

| | | | |
|---|---|---|---|
| 3,633,783 | A | 1/1972 | Aue |
| 4,118,266 | A | 10/1978 | Kerr |
| 6,305,768 | B1 | 10/2001 | Nishimoto |
| 6,485,122 | B2 | 11/2002 | Wolf et al. |
| 8,486,215 | B2 | 7/2013 | Amann et al. |
| 10,030,905 | B2 | 7/2018 | Allard et al. |
| 10,473,217 | B2 | 11/2019 | Deka et al. |
| 10,697,699 | B2 | 6/2020 | Krishna et al. |
| 10,807,298 | B2 | 10/2020 | Allard et al. |
| 10,914,511 | B2 | 2/2021 | Naik et al. |
| 2003/0006025 | A1 | 1/2003 | Manini et al. |
| 2016/0258671 | A1 | 9/2016 | Allard et al. |
| 2017/0268715 | A1 | 9/2017 | Hirai et al. |
| 2017/0325634 | A1 | 11/2017 | Cai et al. |
| 2019/0128594 | A1 | 5/2019 | Allard et al. |

FOREIGN PATENT DOCUMENTS

| | | | |
|---|---|---|---|
| EP | 1338219 | B1 | 9/2012 |
| EP | 2865973 | A1 | 4/2015 |
| WO | 0160598 | A2 | 8/2001 |
| WO | 2010007783 | A1 | 1/2010 |
| WO | 2011058678 | A1 | 5/2011 |
| WO | 2016095224 | A1 | 6/2016 |
| WO | 2016141021 | A1 | 9/2016 |

ENCAPSULATION SYSTEM FOR A THERMAL BRIDGE BREAKER-TO-METAL LINER

CROSS-REFERENCE TO RELATED APPLICATION

The present application is a continuation of U.S. patent application Ser. No. 17/835,018 filed Jun. 8, 2022, now U.S. Pat. No. 12,055,344, which is a divisional of U.S. patent application Ser. No. 16/309,734 filed Dec. 13, 2018, now U.S. Pat. No. 11,402,149, which is a national stage entry of PCT/US2016/055161 filed Oct. 3, 2016, all of which are entitled ENCAPSULATION SYSTEM FOR A THERMAL BRIDGE BREAKER-TO-METAL LINER, the entire disclosures of which are hereby incorporated herein by reference.

FIELD OF THE DEVICE

The device is in the field of structural cabinets for appliances, and more specifically, an encapsulation system for attaching a metallic liner and metallic wrapper to a plastic thermal trim breaker.

SUMMARY

In at least one aspect, an appliance includes an outer wrapper, an inner liner, a trim breaker having a wrapper channel that receives a wrapper edge of the outer wrapper and a liner channel that receives a liner edge of the inner liner. An insulation material disposed within an insulating cavity is defined between the outer wrapper, the inner liner and the trim breaker. A multi-component thermal encapsulation material defines a pre-mix state, an application state and a sealing state. The pre-mix state is defined by distinct components of the thermal encapsulation material being separated from one another, the application state defined by the distinct components combined together into an uncured state of the thermal encapsulation material, and the sealing state defined by the thermal encapsulation material disposed within the wrapper and liner channels and surrounding the wrapper and liner edges, respectively, in the sealing state that defines a hermetic seal between the trim breaker and the outer wrapper and the inner liner.

In at least another aspect, a method for forming an insulating cabinet for an appliance includes disposing distinct components of a multi-part thermal encapsulation material into respective dispensing chambers to define a pre-mix state of the thermal encapsulation material. The distinct components of the thermal encapsulation material are delivered from the respective dispensing chambers to a mixing chamber. The distinct components are mixed in the mixing chamber to define an application state of the thermal encapsulation material. The thermal encapsulation material is delivered in the application state to a liner channel and a wrapper channel of a trim breaker. A wrapper edge of an outer wrapper is disposed into the wrapper channel so that the thermal encapsulation material surrounds both sides of the wrapper edge within the wrapper channel. A liner edge of an inner liner is disposed into the liner channel so that the thermal encapsulation material surrounds both sides of the liner edge within the liner channel. The thermal encapsulation material is cured within the wrapper and liner channels to define a sealing state of the thermal encapsulation material, wherein the thermal encapsulation material in the sealing state defines a hermetic seal between the inner liner and the trim breaker and between the outer wrapper and the trim breaker.

In at least another aspect, a method for forming an insulating cabinet for an appliance includes disposing a first component and second components of a thermal encapsulation material into respective first and second dispensing chambers to define a pre-mix state of the thermal encapsulation material. The first and second components of the thermal encapsulation material are delivered from the respective first and second dispensing chambers to a mixing chamber. The thermal encapsulation material is activated by combining the first and second components within the mixing chamber to generate a chemical reaction that defines an application state of the thermal encapsulation material. The thermal encapsulation material is disposed in the application state into a liner channel and a wrapper channel of a trim breaker. A portion of an inner liner is positioned within the thermal encapsulation material in the liner channel. A portion of an outer wrapper is positioned within the thermal encapsulation material in the wrapper channel. The thermal encapsulation material is cured around the portions of the inner liner and outer wrapper within the liner and wrapper channels, respectively, wherein the cured thermal encapsulation material defines a sealing state of the thermal encapsulation material that is characterized by a hermetic seal between the inner liner and the trim breaker and between the outer wrapper and the trim breaker.

These and other features, advantages, and objects of the present device will be further understood and appreciated by those skilled in the art upon studying the following specification, claims, and appended drawings.

DETAILED DESCRIPTION OF EMBODIMENTS

Figure 1:
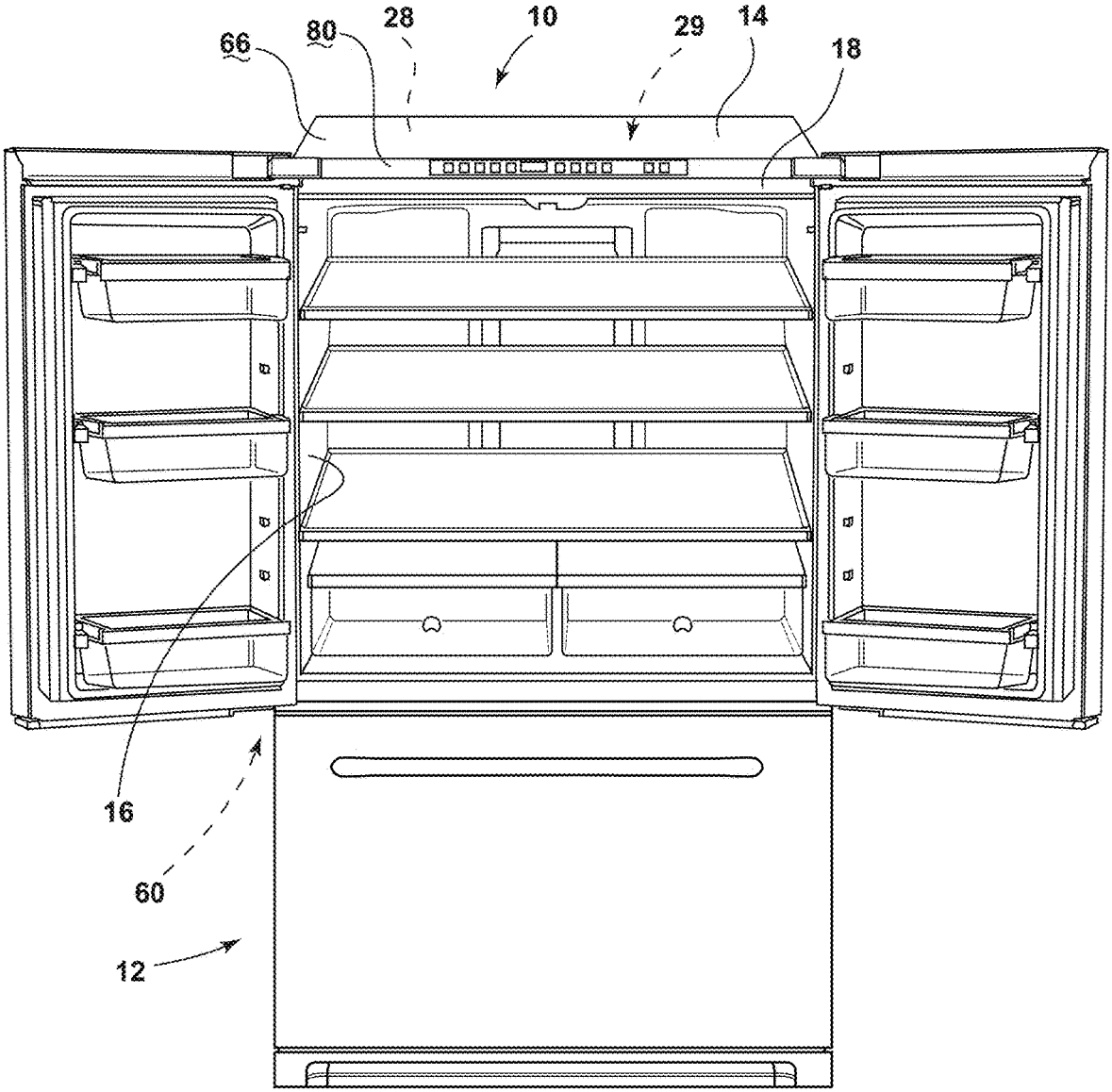
FIG. 1 is a front perspective view of an appliance incorporating a thermal trim breaker that is attached to an outer wrapper and inner liner using an aspect of the encapsulation system.
Figure 2:
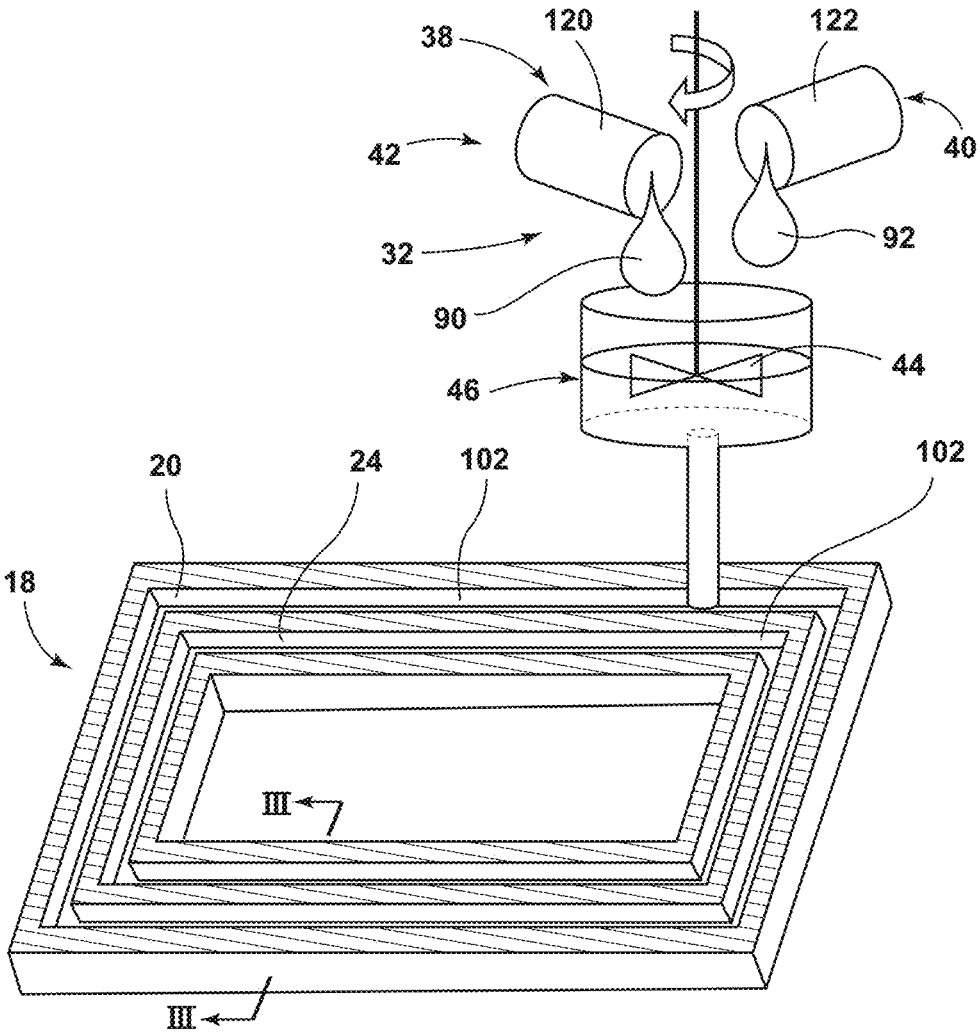
FIG. 2 is a schematic perspective view of a thermal encapsulation material delivery system for disposing the thermal encapsulation material within a thermal trim breaker.
Figure 3:
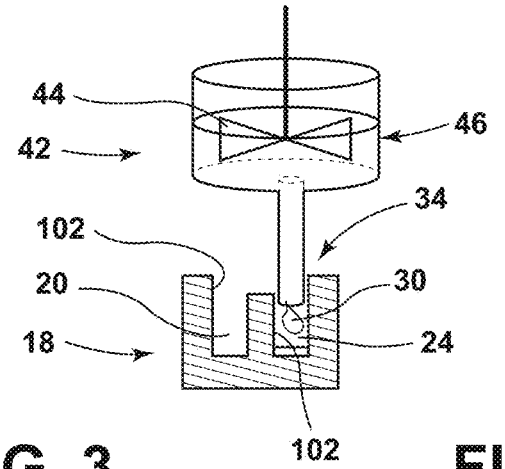
FIG. 3 is a schematic cross-sectional view of the trim breaker of FIG. 2, taken along line III-III, and showing deposition of the thermal encapsulation material within the wrapper and liner channels of the thermal trim breaker.
Figure 4:
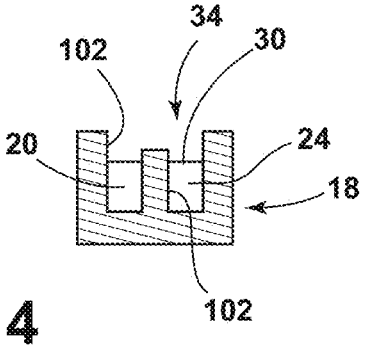
FIG. 4 is a cross-sectional view of the thermal trim breaker of FIG. 3 showing the thermal encapsulation material disposed within the wrapper and liner channels.
Figure 5:
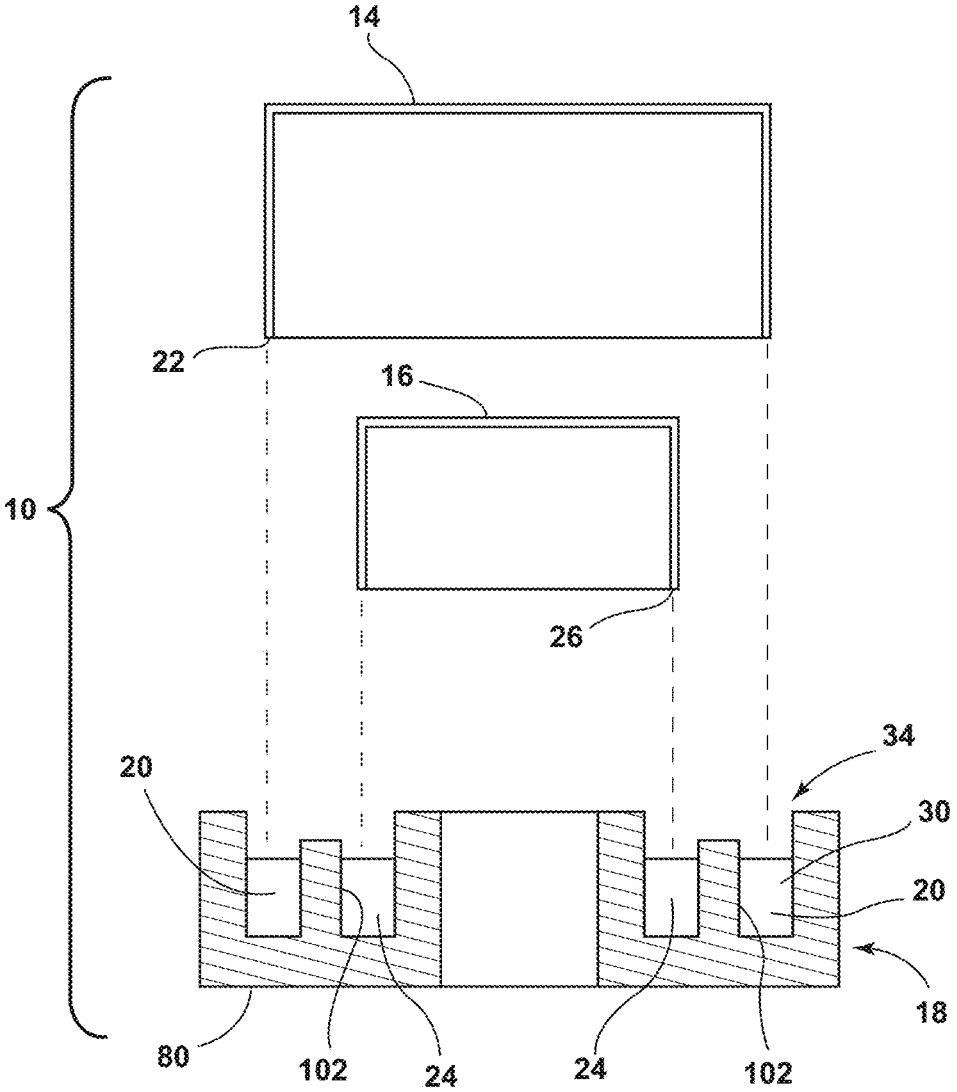
FIG. 5 is a schematic cross-sectional view showing an outer wrapper and inner liner being placed within the wrapper and liner channels of a thermal trim breaker using the thermal encapsulation material.
Figure 6:
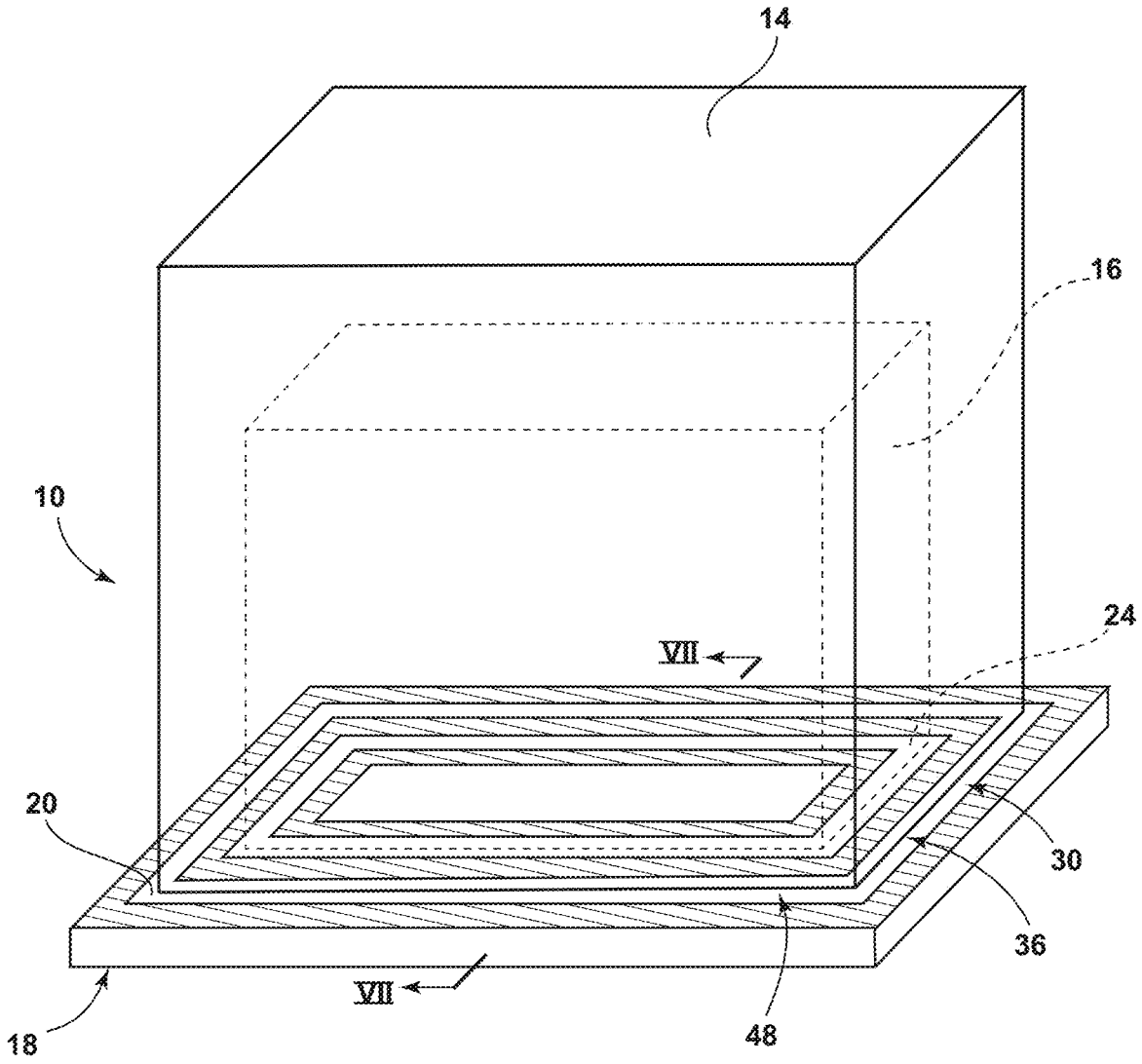
FIG. 6 is a schematic perspective view of a structural cabinet assembled using an aspect of the thermal encapsulation material.
Figure 7:
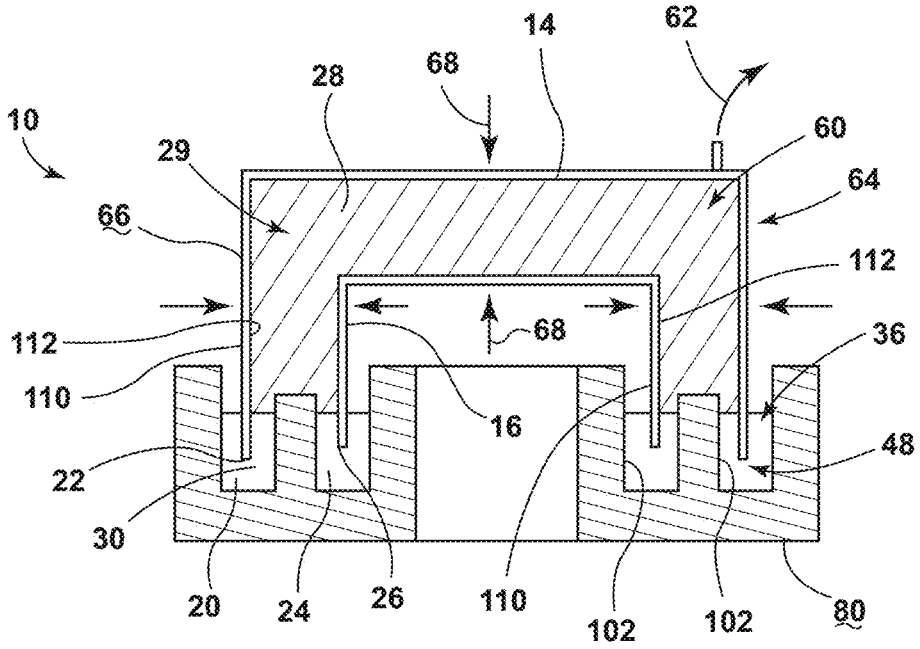
FIG. 7 is a schematic cross-sectional view of the cabinet of FIG. 6 taken along line VII-VII, and showing the outer wrapper and inner liner disposed within the wrapper and liner channels of the thermal trim breaker.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-7, reference numeral 10 generally refers to a structural cabinet for an appliance 12, where the structural cabinet 10 can define a vacuum insulated structure or can house various vacuum insulated structures that add thermal functionality to the performance of the appliance 12. According to the various embodiments, the appliance 12 includes an outer wrapper 14, an inner liner 16 and a trim breaker 18, such as a thermal trim breaker 18, that can be attached to define the structural cabinet 10 for the appliance 12. The trim breaker 18 includes a wrapper channel 20 that receives a wrapper edge 22 of the outer wrapper 14. The trim breaker 18 also includes a liner channel 24 that receives a liner edge 26 of the inner liner 16. An insulation material 28 can be disposed within an insulating cavity 29 defined within the structural cabinet 10 inbetween the outer wrapper 14, inner liner 16 and trim breaker 18. The trim breaker 18 can be attached to the inner liner 16 and outer wrapper 14 using a multi-component thermal encapsulation material 30 that defines a pre-mix state 32, an application state 34, and a sealing state 36. The pre-mix state 32 is defined by two or more distinct components 38 of the thermal encapsulation material 30 being separate from one another within separate component dispensing chambers 40 of a material delivery mechanism 42. The application state 34 of the thermal encapsulation material 30 is defined by the distinct components 38 being combined together by an impeller 44 or other mixing device within a mixing chamber 46 of the material delivery mechanism 42. As the distinct components 38 are mixed together in the mixing chamber 46, the thermal encapsulation material 30 defines the uncured application state 34 of the thermal encapsulation material 30. The thermal encapsulation material 30 in the application state 34 is sufficiently fluid to allow for deposition of the thermal encapsulation material 30, while in the application state 34, to be disposed within the liner and wrapper channels 24, 20 of the thermal trim breaker 18. The sealing state 36 of the thermal encapsulation material 30 is defined by the thermal encapsulation material 30 being disposed, in a cured state, within the liner and wrapper channels 24, 20 of the thermal trim breaker 18. In the sealing state 36, the thermal encapsulation material 30 surrounds the wrapper and liner edges 22, 26, respectively, and is cured to define a hermetic seal 48 between the trim breaker 18 and the outer wrapper 14 in between the trim breaker 18 and the inner liner 16.

Referring again to FIGS. 1-7, it is contemplated that the thermal encapsulation material 30 in the sealing state 36 can be used to generate the hermetic seal 48 at the trim breaker 18 to allow for an at least partial vacuum 60 to be generated within the insulating cavity 29 of the structural cabinet 10. The at least partial vacuum 60 can be generated through the expression, expulsion, or other removal of gas 62 from the insulating cavity 29. This removal of gas 62 creates a pressure differential 64 between the atmosphere around the exterior 66 of the structural cabinet 10 and the at least partial vacuum 60 within the insulating cavity 29. This pressure differential 64 generates an inward compressive force 68 that is exerted upon the outer wrapper 14, the inner liner 16 and the trim breaker 18 in the direction of the insulating cavity 29. As this inward compressive force 68 is applied on the outer wrapper 14 and inner liner 16, certain bending, flexion, movement or other deflection of the inner liner 16 and outer wrapper 14 may occur. It is contemplated that the thermal encapsulation material 30 in the sealing state 36 can be at least partially elastic to allow for movement of the liner edge 26 and wrapper edge 22 within the liner and wrapper channels 24, 20, respectively, without losing, damaging or otherwise degrading the hermetic seal 48 between the inner liner 16 and the trim breaker 18 and the outer wrapper 14 and the trim breaker 18. It is contemplated that use of the thermal encapsulation material 30 is particularly useful where the thermal trim breaker 18 is made of a different material than the inner liner 16 and outer wrapper 14. Typically, the thermal trim breaker 18 will be made of plastic or other similar polymer material, and the inner liner 16 and outer wrapper 14 will each be made of a metallic material.

According to the various embodiments, the structural cabinet 10 that forms the vacuum insulated structure provides for heat transfer between the metal inner liner 16 and the metal outer wrapper 14 with the vacuum insulated structure. When the plastic trim breaker 18 separates the inner liner 16 and outer wrapper 14, these components typically have a lower heat transfer rate than would be found in a direct metal-to-metal connection between a metallic inner liner 16 and a metallic outer wrapper 14. The trim breaker 18 is installed at a front face 80 of the structural cabinet 10 and is used as a cap to keep the core materials, such as various insulating materials, inside the insulating cavity 29 between the inner liner 16 and the outer wrapper 14. The thermal encapsulation material 30 used to attach the inner liner 16 to the trim breaker 18 and the outer wrapper 14 to the trim breaker 18 provides a sturdy connection mechanism for maintaining a sealed engagement between these dissimilar materials and allowing for the generation of an at least partial vacuum 60 within the insulating cavity 29.

Referring again to FIGS. 1-7, the use of dissimilar metals in the structural cabinet 10 between the metallic inner liner 16, the metallic outer wrapper 14 and the plastic thermal trim breaker 18 results in the metallic portions of the structural cabinet 10 having a different coefficient of thermal expansion than that of the plastic components of the structural cabinet 10. The elastic nature of the thermal encapsulation material 30 in the sealing state 36 allows for these minimal expansion movements of differing degree between the typically cooler metallic inner liner 16, the typically warmer outer wrapper 14 and the plastic trim breaker 18 extending therebetween. It is contemplated that the thermal encapsulation material 30 can operate to provide a sturdy hermetic seal 48 between the inner liner 16 and the trim breaker 18 and the outer wrapper 14 and the trim breaker 18 under different temperature environments typically found within and around refrigerating appliances 12.

According to the various embodiments, it is contemplated that the thermal encapsulation material 30 can be any one of various materials that can include, but are not limited to, thermosetting polymers, thermoplastics, elastomers, combinations thereof, and other similar materials. More specifically, the thermal encapsulation material 30 can include any one or more of various epoxies, silicones, polyurethanes, acrylics, polyimides, silicone polyimides, parylenes, polycyclicolefins, silicon-carbons, benzocyclobutenes, liquid crystal polymers, combinations thereof, and other similar encapsulating materials. It is contemplated that the thermal encapsulation material 30 can include first and second components 90, 92, and can also include additional distinct components 38 that can be combined to form the application and sealing states 34, 36 of the thermal encapsulation material 30.

Figure 8:
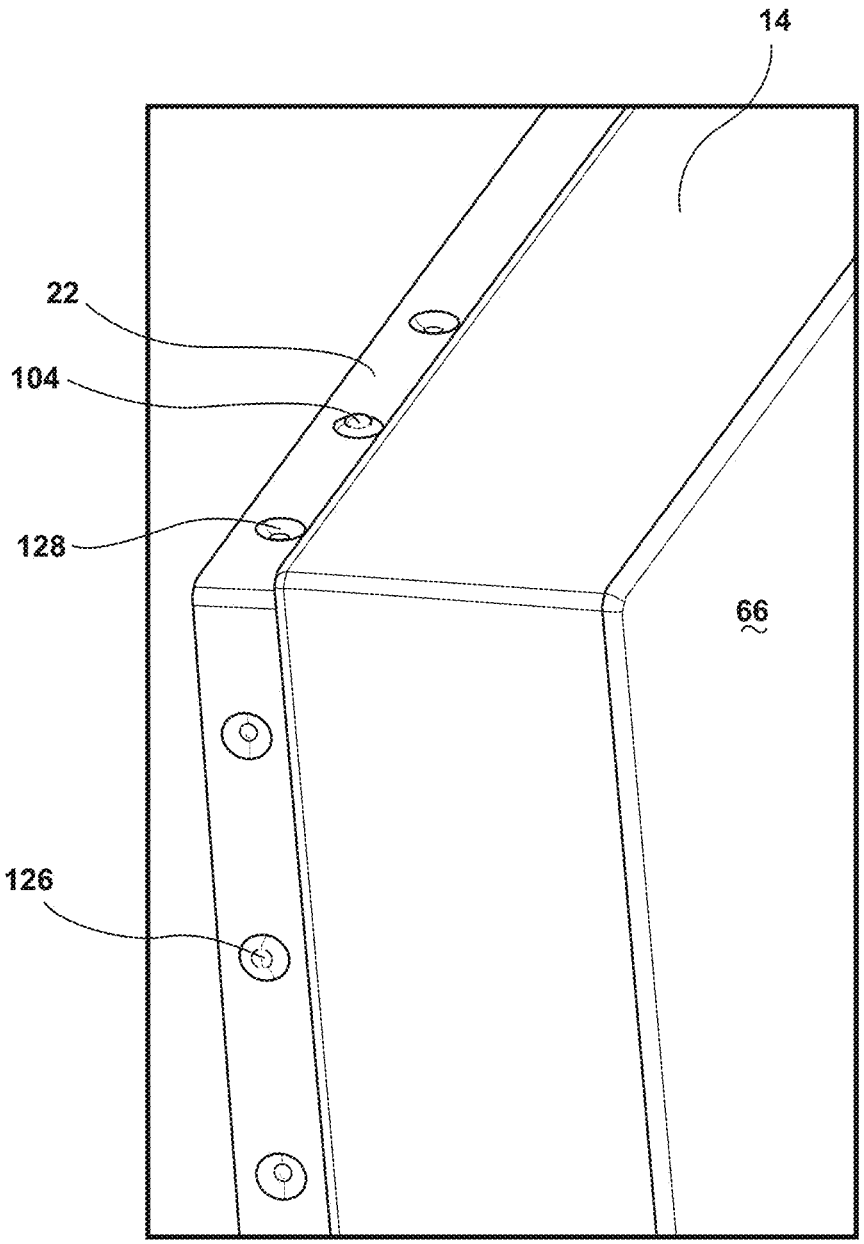
FIG. 8 is a perspective view of a wrapper edge of an outer wrapper incorporating a plurality of wrapper protrusions.
Figure 9:
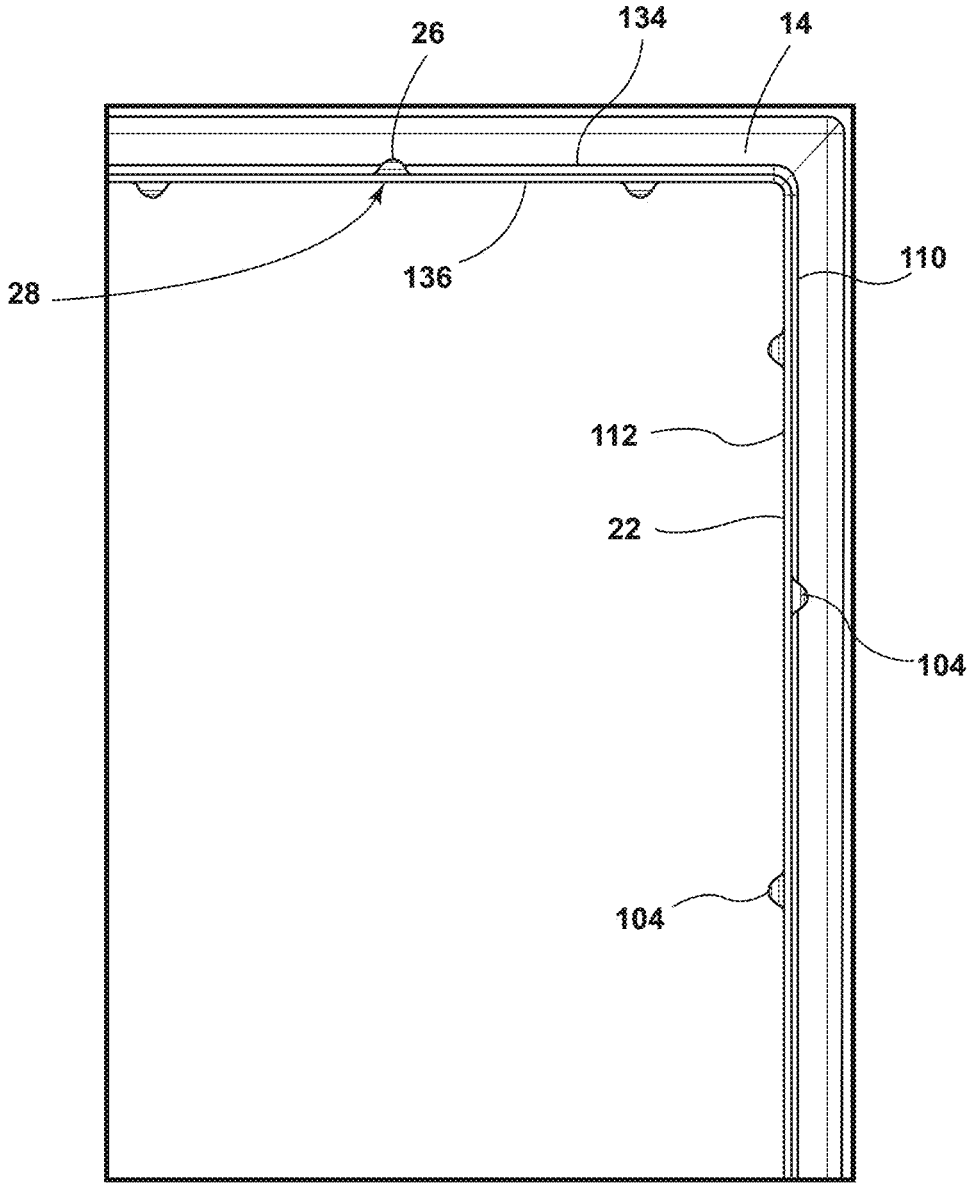
FIG. 9 is an elevational view of the wrapper of FIG. 8.
Figure 10:
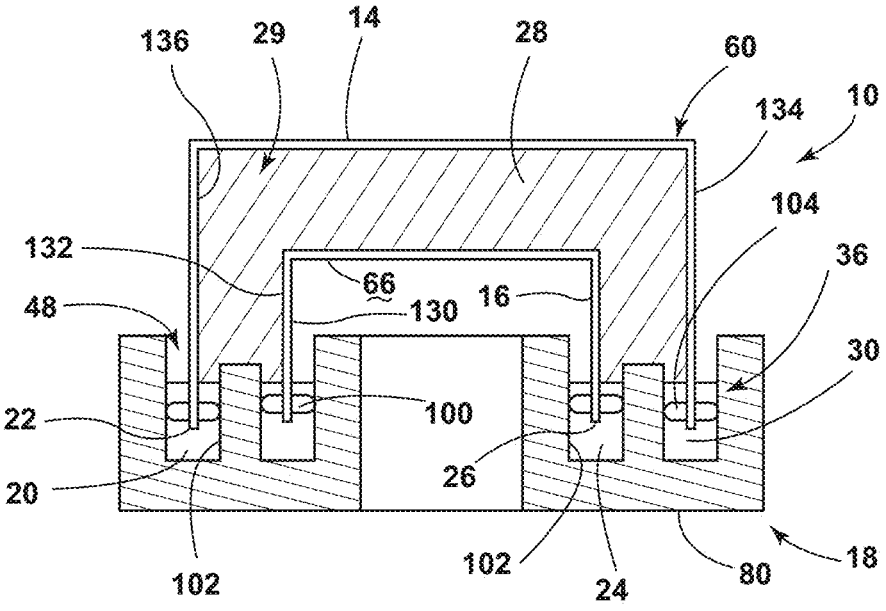
FIG. 10 is a schematic cross-sectional view of a structural cabinet assembled using an aspect of the thermal encapsulation material and a plurality of positioning protrusions disposed on the outer wrapper and inner liner.

Referring now to FIGS. 8-10, it is contemplated that the liner edge 26 can include a plurality of liner protrusions 100 that engage at least one sidewall 102 of the liner channel 24. Engagement of the plurality of liner protrusions 100 with the liner channel 24 serves to center the liner edge 26 within the liner channel 24. In this manner, the centering of the liner edge 26 within the liner channel 24 serves to allow the thermal encapsulation material 30 to extend around and engage both of opposing first and second sides 110, 112 of the liner edge 26. Similarly, the wrapper edge 22 can include a plurality of wrapper protrusions 104 that engage at least one sidewall 102 of the wrapper channel 20. As with the liner protrusions 100, engagement of a plurality of wrapper protrusions 104 with the wrapper channel 20 serves to center the wrapper edge 22 within the wrapper channel 20. As with the liner protrusions 100 being disposed within the liner channel 24, the use of the wrapper protrusions 104 serves to center the wrapper edge 22 within the wrapper channel 20 to allow the thermal encapsulation material 30 to be disposed around both of the opposing first and second sides 110, 112 of the wrapper edge 22. Through the use of the liner and wrapper protrusions 100, 104, the thermal encapsulation material 30 can be allowed to flow or otherwise extend around both sides of the liner edge 26 and the wrapper edge 22. Accordingly, the thermal encapsulation material 30 surrounds the liner and wrapper edges 22 to fully encapsulate the liner edge 26 and wrapper edge 22 within the liner and wrapper channels 24, 20, respectively.

According to the various embodiments, it is contemplated that placement of the liner and wrapper edges 26, 22 within the liner and wrapper channels 24, 20, respectively, can result in the liner and wrapper edges 26, 22 being free of direct contact with the thermal trim breaker 18. In such an embodiment, the thermal encapsulation material 30 can completely surround and separate the liner and wrapper edges 26, 22 from the sidewalls 102 of the liner and wrapper channels 24, 20. Accordingly, the thermal encapsulation material 30 provides an additional thermal barrier that slows the degree of thermal transfer between the metallic outer wrapper 14 and the trim breaker 18 and the metallic inner liner 16 and the trim breaker 18.

According to aspects of the device that include the liner and wrapper protrusions 100, 104, as exemplified in FIGS. 8-10, it is contemplated that the liner and wrapper protrusions 100, 104 can be substantially hemispheric members that extend from opposing first and second sides 110, 112, in an alternating fashion, of each of the inner liner 16 and outer wrapper 14. The hemisphere configuration of the liner and wrapper protrusions 100, 104 allows for a minimal contact area between the liner edge 26 and the liner channel 24 and between the wrapper edge 22 and the wrapper channel 20. This minimal degree of contact minimizes the amount of thermal transfer that may occur through the direct engagement between the inner liner 16 and the trim breaker 18 and the outer wrapper 14 and the trim breaker 18.

Referring again to FIGS. 1-7, after the inner liner 16 and outer wrapper 14 have been disposed within the liner channel 24 and wrapper channel 20 of the trim breaker 18, respectively, the thermal encapsulation material 30 cures to form the sealing state 36 of the thermal encapsulation material 30. At this point, gas 62 can be expressed, expelled, or otherwise removed from the insulating cavity 29 of the structural cabinet 10 to define an at least partial vacuum 60 within the structural cabinet 10. It is contemplated that the insulation material 28 can be disposed between the inner liner 16 and outer wrapper 14 either before or after the trim breaker 18 is attached to the inner liner 16 and the outer wrapper 14.

Having described various aspects of the structural cabinet 10 using aspects of the thermal encapsulation material 30, a method 400 is disclosed for forming an insulative structural cabinet 10 for an appliance 12 using aspects of the thermal encapsulation material 30. According to the method 400, distinct components 38 of a multi-part thermal encapsulation material 30 are disposed into respective dispensing chambers 40 (step 402). The separation of the distinct components 38 of the thermal encapsulation material 30 defines a premix state 32 of the thermal encapsulation material 30. It is contemplated that the distinct components 38 of the thermal encapsulation material 30, by themselves, can be substantially inert and typically do not serve as a proper adhesive or encapsulation material 30 for the structural cabinet 10. The distinct components 38 are then delivered from the respective dispensing chambers 40 to the mixing chamber 46 of the material delivery mechanism 42 (step 404). The distinct components 38 having been disposed in the mixing chamber 46 are then mixed by an impeller 44 within the mixing chamber 46 to define an uncured application state 34 of the thermal encapsulation material 30 (step 406).

It is contemplated that the application state 34 of the thermal encapsulation material 30 is a substantially fluid state that allows for pouring or flowing of the thermal encapsulation material 30 into the liner channel 24 and wrapper channel 20 of the thermal breaker. It is also contemplated that the application state 34 of the thermal encapsulation material 30 can be a more viscous material that may be injected or otherwise compressed or molded into the liner channel 24 and wrapper channel 20 of the trim breaker 18.

According to the method 400, after the components of the thermal encapsulation material 30 have been mixed to define the application state 34, the thermal encapsulation material 30 in the application state 34 is delivered to the liner channel 24 and the wrapper channel 20 of the trim breaker 18 (step 408). The wrapper edge 22 of the outer wrapper 14 is then disposed into the wrapper channel 20 so that the thermal encapsulation material 30 in the application state 34 surrounds both sides of the wrapper edge 22 within the wrapper channel 20 (step 410). Similarly, the liner edge 26 of the inner liner 16 is disposed into the liner channel 24 so that the thermal encapsulation material 30 can surround both sides of the liner edge 26 within the liner channel 24 (step 412). It is contemplated that steps 410 and 412 can be performed simultaneously or can be switched in order such that the inner liner 16 is first placed within the liner channel 24 and then, subsequently, the outer wrapper 14 is placed within the wrapper channel 20. After the inner liner 16 and outer wrapper 14 are placed within the thermal encapsulation material 30 in the application state 34, the thermal encapsulation material 30 is then cured within the wrapper and liner channels 20, 24 to define a sealing state 36 of the thermal encapsulation material 30 (step 414). As discussed above, the thermal encapsulation material 30 in the sealing state 36 defines a hermetic seal 48 between the inner liner 16 and the trim breaker 18 and between the outer wrapper 14 and the trim breaker 18.

Referring again to FIGS. 1-7, after formation of the structural cabinet 10, the insulation material 28 can be disposed within an insulating cavity 29 defined between the inner liner 16 and the outer wrapper 14. Gas 62 can then be expressed from the insulating cavity 29 and from the insulation material 28 defined within the insulating cavity 29. This expression of gas 62 serves to define the at least partial vacuum 60 within the insulating cavity 29. It is contemplated that the thermal encapsulation material 30 in the sealing state 36 permits at least partial movement of the inner liner 16 and outer wrapper 14 during and after the expression of gas 62 from the insulating cavity 29. The encapsulation material 30 allows for this partial movement while also maintaining a hermetic seal 48 between the inner liner 16 and the trim breaker 18 and between the outer wrapper 14 and the trim breaker 18.

Referring again to FIGS. 1-7, it is contemplated that the thermal encapsulation material 30 can include first and second components 90, 92 that are disposed within respective first and second dispensing chambers 120, 122 of the material delivery mechanism 42, when the thermal encapsulation material 30 is in a pre-mix state 32.

Figure 11:
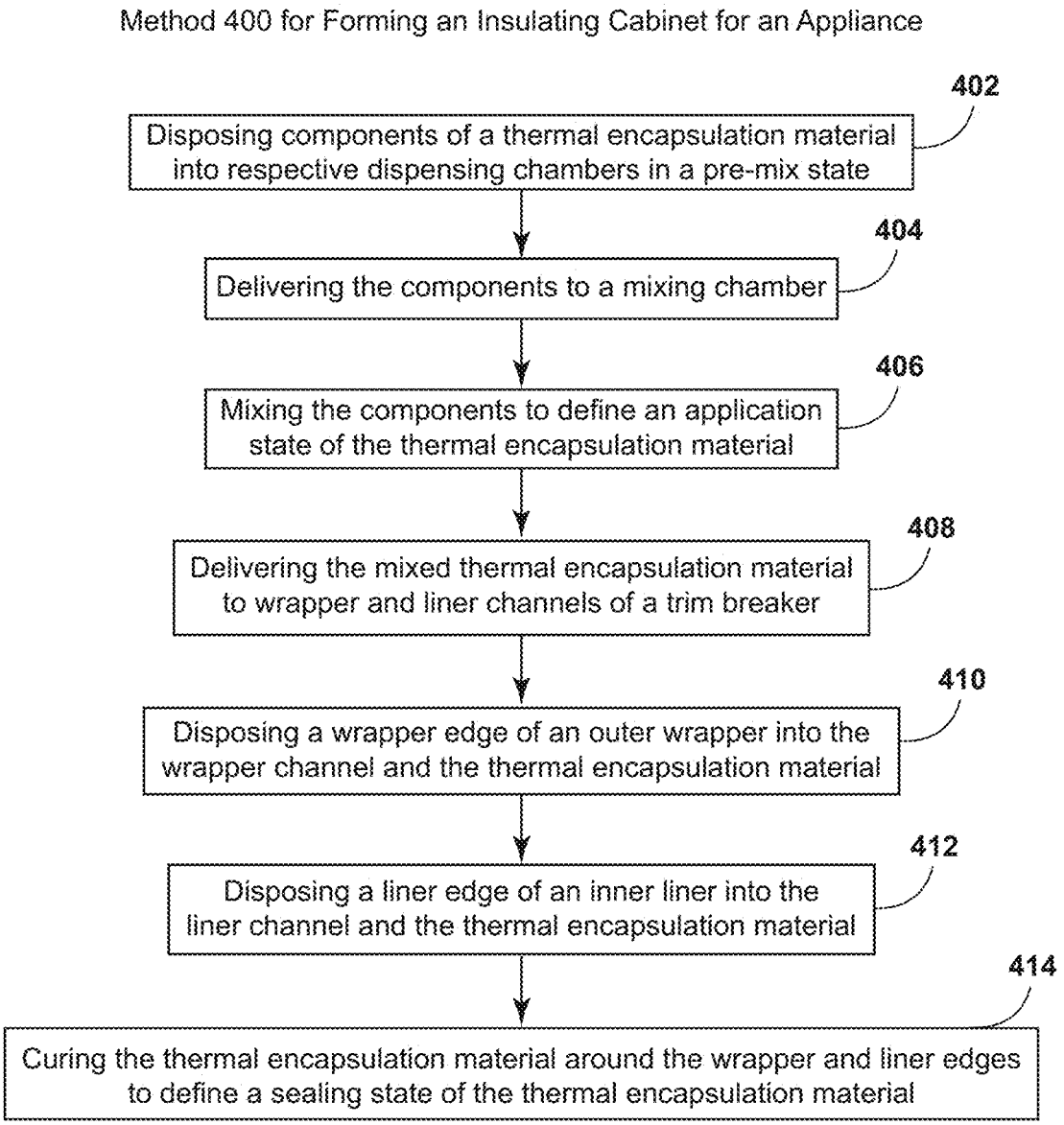
FIG. 11 is a schematic flow diagram illustrating a method for forming an insulating cabinet for an appliance using a thermal encapsulation material.
Figure 12:
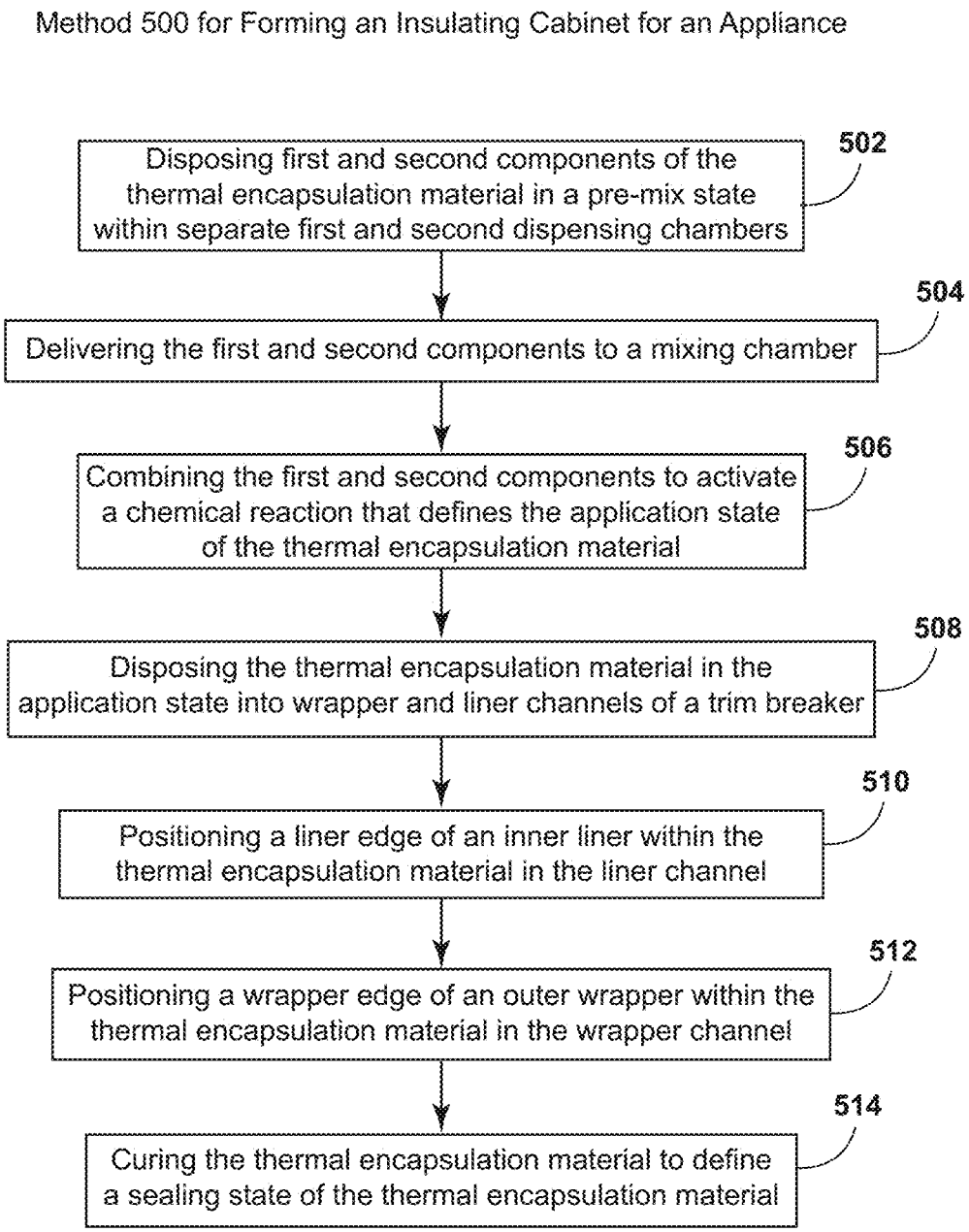
FIG. 12 is a schematic flow diagram illustrating a method for forming an insulated cabinet for an appliance using an aspect of a thermal encapsulation material.

Referring again to FIGS. 9-11, it is contemplated that the step 412 of disposing the inner liner 16 within the liner channel 24 can include centering the liner edge 26 within the liner channel 24 using the liner protrusions 100 that engage at least one sidewall 102 within the liner channel 24. As discussed above, engagement plurality of liner protrusions 100 with the liner channel 24 serves to center the liner edge 26 within the liner channel 24 such that the thermal encapsulation material 30 engages both sides of the liner edge 26. Similarly, the step 410 of disposing the wrapper edge 22 within the wrapper channel 20 includes centering the wrapper edge 22 within the wrapper channel 20 using the wrapper protrusions 104. As with the liner protrusions 100, the wrapper protrusions 104 serve to center the wrapper edge 22 within the wrapper channels 20 such that the thermal encapsulation material 30 engages both sides of the wrapper edge 22.

According to the various embodiments, it is contemplated that the liner and wrapper protrusions 100, 104 can be hemispheric projections, dimples, detents, indents, combinations thereof, and other similar protrusions. Typically, the protrusions will be pressed or punched formations within the surface of the inner liner 16 and outer wrapper 14 such that one side of the protrusion projects outward from one surface of the inner liner/outer wrapper 16, 14 and the opposing side of the outward protrusion 126 defines an inward indent 128 within the opposing first and second sides 110, 112 of each of the inner liner/outer wrapper 16, 14. These geometries of the liner and wrapper protrusions 100, 104 can also serve to increase the retaining force of the thermal encapsulation material 30 with the inner liner 16 and outer wrapper 14. Stated another way, the liner protrusion 100 defines the outward protrusion 126 on a first liner surface 130 and the inward indent 128 on an opposing second liner surface 132. Similarly, the wrapper protrusions 104 can define the outward protrusion 126 on a first wrapper surface 134 and the inward indent 128 on a second wrapper surface 136. In this manner, the wrapper and liner protrusions 104, 100 define alternating outward protrusions 126 and inward indents 128 along the opposing surfaces of the inner liner 16 and outer wrapper 14.

Referring again to FIGS. 1-10 and 12, a method 500 is disclosed for forming an insulating structural cabinet 10 for an appliance 12 using an aspect of the thermal encapsulation material 30. According to the method 500, first and second components 90, 92 of a thermal encapsulation material 30 are disposed into respective first and second dispensing chambers 120, 122 to define a pre-mix state 32 of the thermal encapsulation material 30 (step 502). The first and second components 90, 92 are then delivered from the respective first and second dispensing chambers 120, 122 to a mixing chamber 46 (step 504). The thermal encapsulation material 30 is activated by combining the first and second components 90, 92 of the thermal encapsulation material 30 within the mixing chamber 46 to generate a chemical reaction that defines an application state 34 of the thermal encapsulation material 30 (step 506).

As discussed above, the application state 34 of the thermal encapsulation material 30 can be a fluid and substantially flowable material or can be a more viscous and injectable material that can be disposed within the liner and wrapper channels 24, 20 of the trim breaker 18.

According to the method 500, the thermal encapsulation material 30 is then disposed, while in the application state 34, into the liner channel 24 and the wrapper channel 20 of the trim breaker 18 (step 508). A portion of the inner liner 16 is then positioned, and typically centered, within the thermal encapsulation material 30 in the liner channel 24 (step 510). A portion of the outer wrapper 14 is then positioned and typically centered, within the thermal encapsulation material 30 within the wrapper channel 20 (step 512). The thermal encapsulation material 30 is then cured around the portions of the inner liner 16 and outer wrapper 14 that are disposed within the liner and wrapper channels 24, 20, respectively (step 514). The cured thermal encapsulation material 30 defines the sealing state 36 of the thermal encapsulation material 30 that is characterized by a hermetic seal 48 between the inner liner 16 of the trim breaker 18 and between the outer wrapper 14 of the trim breaker 18.

As discussed above, each of the inner liner 16 and outer wrapper 14 can include positioning features, typically in the form of the liner and wrapper protrusions 100, 104, that at least partially engage the liner channel 24 and the wrapper channel 20, respectively. It is contemplated that the positioning features are adapted to centrally align the inner liner 16 within the liner channel 24 and to also centrally align the outer wrapper 14 within the wrapper channel 20. According to various embodiments, it is contemplated that the positioning features can define minimal contact between the liner and wrapper edges 26, 22 and the liner and wrapper channels 24, 20, respectively. It is also contemplated that the positioning features can be configured to space the liner and wrapper edges 26, 22 away from the sidewalls 102 of the liner and wrapper channels 24, 20, respectively. In such an embodiment, the liner and wrapper edges 26, 22 are free of direct engagement with the liner and wrapper channels 24, 20 and are fully separated by the thermal encapsulation material 30.

According to the various embodiments, it is contemplated that the thermal encapsulation material 30 can be used in the formation of structural cabinets 10 for various appliances 12. These appliances 12 can include, but are not limited to, refrigerators, freezers, coolers, ovens, dishwashers, laundry appliances, water heaters, and other similar appliances 12 and fixtures within household and commercial settings.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A trim breaker assembly for an appliance, the trim breaker assembly comprising:

a trim breaker having a wrapper channel configured to receive a wrapper edge of an outer wrapper and a liner channel configured to receive a liner edge of an inner liner;

a multi-component thermal encapsulation material defining a pre-mix state, an application state and a sealing state, the pre-mix state defined by distinct components of the multi-component thermal encapsulation material being separated from one another, the application state defined by the distinct components combined together into an uncured state of the multi-component thermal encapsulation material, and the sealing state defined by the multi-component thermal encapsulation material disposed within the wrapper and liner channels and surrounding the wrapper and liner edges, respectively, in the sealing state that is configured to define a seal between the trim breaker and the wrapper edge and the liner edge; and a centering assembly that is configured to centrally position the wrapper edge within wrapper channel sidewalls of the wrapper channel of the trim breaker and to centrally position the liner edge within liner channel sidewalls of the liner channel of the trim breaker.

2. The trim breaker assembly of claim 1, wherein the trim breaker is made of plastic.

3. The trim breaker assembly of claim 1, wherein the multi-component thermal encapsulation material includes at least one of epoxy, silicone, polyurethane, acrylic, polyimide, silicone polyimide, parylene, polycyclicolefin, silicon-carbon, benzocyclobutene, and a liquid crystal polymer.

4. The trim breaker assembly of claim 1, wherein the multi-component thermal encapsulation material is a thermosetting polymer.

5. The trim breaker assembly of claim 1, wherein the multi-component thermal encapsulation material is configured to engage opposing sides of the inner liner and both sides of the outer wrapper.

6. The trim breaker assembly of claim 1, wherein the wrapper channel sidewalls and the liner channel sidewalls at least partially define a sidewall of the trim breaker that separates the liner channel from the wrapper channel.

7. The trim breaker assembly of claim 1, wherein the centering assembly is configured to be attached to the liner edge of the inner liner.

8. The trim breaker assembly of claim 1, wherein the centering assembly is configured to be attached to the wrapper edge of the outer wrapper.

9. The trim breaker assembly of claim 1, wherein the distinct components of the multi-component thermal encapsulation material includes a first component and a second component.

10. The trim breaker assembly of claim 1, wherein the seal is a hermetic seal.

11. A trim breaker assembly for an appliance, the trim breaker assembly comprising:

a trim breaker having wrapper channel sidewalls that define a wrapper channel and liner channel sidewalls that define a liner channel;

a multi-component thermal encapsulation material defining a pre-mix state, an application state and a sealing state, the pre-mix state defined by distinct components of the multi-component thermal encapsulation material being separated from one another, the application state defined by the distinct components combined together into an uncured state of the multi-component thermal encapsulation material, and the sealing state defined by the multi-component thermal encapsulation material disposed within the wrapper channel and the liner channel and surrounding the wrapper edge and the liner edge, respectively, in the sealing state that defines a seal between the trim breaker and the wrapper edge and the liner edge;

a wrapper edge that is configured to be disposed within the multi-component thermal encapsulation material within the wrapper channel;

a liner edge that is configured to be disposed within the multi-component thermal encapsulation material within the liner channel; and a centering assembly that is configured to centrally position the wrapper edge between the wrapper channel sidewalls of the wrapper channel and to centrally position the liner edge between the liner channel sidewalls of the liner channel.

12. The trim breaker assembly of claim 11, wherein the multi-component thermal encapsulation material is a thermosetting polymer.

13. The trim breaker assembly of claim 11, wherein the multi-component thermal encapsulation material is configured to engage opposing sides of the liner edge and both sides of the wrapper edge.

14. The trim breaker assembly of claim 11, wherein the wrapper channel sidewalls and the liner channel sidewalls at least partially define a sidewall of the trim breaker that separates the liner channel from the wrapper channel.

15. The trim breaker assembly of claim 11, wherein the centering assembly is configured to be attached to the liner edge of an inner liner.

16. The trim breaker assembly of claim 11, wherein the centering assembly is configured to be attached to the wrapper edge of an outer wrapper.

17. The trim breaker assembly of claim 11, wherein the distinct components of the multi-component thermal encapsulation material include a first component and a second component.

18. The trim breaker assembly of claim 11, wherein the seal is a hermetic seal.

19. A trim breaker assembly for an appliance, the trim breaker assembly comprising:

a trim breaker having wrapper channel sidewalls that define a wrapper channel configured to receive a wrapper edge of an outer wrapper and liner channel sidewalls that define a liner channel configured to receive a liner edge of an inner liner; and a multi-component thermal encapsulation material defining a pre-mix state, an application state and a sealing state, the pre-mix state defined by distinct components of the multi-component thermal encapsulation material being separated from one another, the application state defined by the distinct components combined together into an uncured state of the multi-component thermal encapsulation material, and the sealing state defined by the multi-component thermal encapsulation material disposed within the wrapper and liner channels and surrounding the wrapper and liner edges, respectively, in the sealing state that is configured to define a seal between the trim breaker and the wrapper edge and the liner edge, wherein at least one of the liner edge and the wrapper edge includes a centering assembly that centrally positions the wrapper edge within the wrapper channel sidewalls of the wrapper channel of the trim breaker and centrally positions the liner edge within the liner channel sidewalls of the liner channel of the trim breaker.

20. The trim breaker assembly of claim 19, wherein the centering assembly includes a plurality of liner protrusions that extend outward from opposing surfaces of the liner edge, wherein a portion of the plurality of liner protrusions extend outward from a first liner surface and extend inward into a second liner surface, and wherein the centering assembly includes a plurality of wrapper protrusions that extend outward from opposing surfaces of the wrapper edge, wherein a portion of the plurality of wrapper protrusions extend outward from a first wrapper surface and extend inward into a second wrapper surface.

* * * * *